US005901434A

United States Patent [19]

Nakano et al.

[11] Patent Number: 5,901,434

[45] Date of Patent: May 11, 1999

[54] TERMINAL INSERTING GUIDE ASSEMBLY

[75] Inventors: Atsushi Nakano; Takamichi Maejima, both of Haibara-gun, Japan

[73] Assignee: Yazaki Corporation

[21] Appl. No.: 08/744,989

[22] Filed: Nov. 7, 1996

[30] Foreign Application Priority Data

Nov. 10, 1995 [JP] Japan ..... 7-292805

[51] Int. Cl.[6] ..... H01R 43/20

[52] U.S. Cl. ..... 29/747; 29/33 M; 29/748; 29/755; 29/760

[58] Field of Search ..... 29/33 F, 33 M, 29/747, 748, 755, 759, 760; 269/903

[56] References Cited

U.S. PATENT DOCUMENTS

| | | | |
|---|---|---|---|
| 4,726,777 | 2/1988 | Billman et al. | 439/70 |
| 4,967,470 | 11/1990 | Folk | 29/748 X |
| 5,459,924 | 10/1995 | Ohsumi et al. | 29/33 F X |
| 5,515,601 | 5/1996 | Maejima | 29/748 |
| 5,657,535 | 8/1997 | Maejima | 29/33 M X |
| 5,697,147 | 12/1997 | Ohsumi et al. | 29/760 X |

FOREIGN PATENT DOCUMENTS

| | | |
|---|---|---|
| 1-068902 | 3/1989 | Japan . |
| 7-114969 | 5/1995 | Japan . |

*Primary Examiner*—Peter Vo

*Attorney, Agent, or Firm*—Armstrong, Westerman, Hattori, McLeland & Naughton

[57] ABSTRACT

A terminal inserting guide assembly includes a pair of guide hooks for guiding a terminal into a connector housing. A first upper guiding surface is formed at an upper end of a cut-out portion inside a first one of the pair of guide hooks. A terminal side guiding projection is formed in a second one of the pair of guide hooks. A second upper guiding surface is formed in the tapered extending portion. The terminal side guiding projection and the tapered extending portion are received in the cut-out portion of the first one of guide hooks, when the pair of guide hooks are closed, in their lateral direction, without a terminal.

5 Claims, 6 Drawing Sheets

TERMINAL INSERTING GUIDE ASSEMBLY

BACKGROUND OF THE INVENTION

1. Field of the Invention

The present invention relates to a terminal inserting guide assembly for reliably guiding a terminal into a connector housing, even a large-width-type terminal having a curved surface, while keeping the terminal in a stable horizontal position.

2. Description of the Prior Art

FIGS. 6 to 9 show a terminal inserting guide assembly 21 that the same assignee as that of the present application disclosed in Japanese Patent Application Laid-open No. 7-114969.

The terminal inserting guide assembly 21 is composed of a pair of openable and closable guide hooks 22, 23. In FIG. 6 (a rear view), the guide hook 22 on the right side of the figure has a vertical frame bar 24 having a substantially equilateral triangle shape in cross-section. Inside an intermediate portion of the frame bar 24, there is a terminal holding space 40 for inserting a terminal 8. Below the holding space 40, the guide hook 22 has a substantially wedge-shaped leading end 25. Further, the guide hook 22 has a substantially triangle-shaped, tapered upper guiding surface 26 positioned at an upper end of the holding space 40. The upper guiding surface 26 guides a top portion of a terminal 8 into a terminal accommodating chamber 28 of a connector housing 27 (FIG. 8). Each side portion 29 or 30 (FIG. 9) of the terminal 8 is guided along a side surface 31 or 32 of the pair of guide hooks 22, 23.

The other guide hook 23 has a frame bar 33 having a substantially right-angled-triangle shape in cross-section. The frame bar 33 includes a terminal guiding side projection 34 (FIG. 8) received in the holding space 40. The terminal side guiding projection 34 has an inside surface serving as a lateral guiding surface. The frame bar 33 has a fore end portion reduced in its longitudinal cross-sectional area. A fore end face 33*a* of the fore end portion abuts against a rear surface 24*a* of a frame bar 24 of the guide hook 22. At the same time, as shown in FIG. 8, a fore end 34*a* of the terminal side guiding projection 34 is in line with a fore end of the guide hook 22. Further, a leading end 35 of the other guide hook 23 abuts against and is aligned over an upper portion of the leading end 25. Thus, the guide hooks 22, 23 engage each other so as to be closed. In FIG. 8, a foot frame 36 is for preventing an electric wire 37 from passing too close to the guiding hooks 22, 23. In FIG. 6, a rear, tapered guiding surface 38 is for guiding the terminal 8.

First, the closed guide hooks 22, 23 are advanced from above, just in front of the connector housing 27. Next, the guide hooks 22, 23 are opened so that the terminal 8, as shown in FIG. 8, can be inserted therein after getting the electric wires 37, which have been inserted in the connector housing 27, out of the way. Getting upper or side electric wire 37 out of the way allows a terminal 8 to enter into a lower terminal accommodating chamber 28. This also enables the terminal 8 to freely enter into a given terminal accommodating chamber. A leading end of the terminal 8 is preliminarily inserted into the chamber 28 by fore and aft, feeding, holding hooks 38, 39, respectively. Then, the whole terminal 8 is finally inserted by the aft hook 39.

However, in the previously known terminal inserting guide assembly 21, as shown in FIG. 9, a large-width, curved-surface type terminal 8 is inserted into a terminal accommodating chamber. The terminal 8 is about 8 mm in its lateral width and has a pair of semicircular-shaped, curved surfaces 17, 18. In such cases, as illustrated by an imaginary line in FIG. 6, the terminal 8 may be inclined laterally, because only the curved surface 18 is contacting the upper guiding surface 26 of the guide hook 22. In the worst case scenario, the terminal 8 cannot enter into the connector housing 27. This has been the drawback in the previously known terminal inserting guide assembly 21.

SUMMARY OF THE INVENTION

In view of the above-described drawback, an object of the present invention is to provide a terminal inserting guide assembly that can reliably insert even a large-width, curved-surface type terminal into a connector housing, while keeping the terminal in a stable horizontal position.

For achieving the above-described object, according to the present invention, a terminal inserting guide assembly is provided which includes: a pair of guide hooks for guiding a terminal into a connector housing, such that each of the pair of guide hooks is formed with each inside guiding surface being capable of slidably contacting an upper curved surface of the terminal. In another effective terminal inserting guide assembly according to the present invention, a terminal inserting guide assembly includes: a pair of guide hooks; a first upper guiding surface formed at an upper end of a cut-out portion inside a first one of the pair of guide hooks; a terminal side guiding projection formed in a second one of the pair of guide hooks; a tapered extending portion formed inside the second one of the pair of guide hooks; a second upper guiding surface formed in the tapered extending portion; and wherein the terminal side guiding projection and the tapered extending portion are received in the cut-out portion of the first one of the pair of guide hooks, when the pair of guide hooks are closed, in their lateral direction, without a terminal.

DETAILED DESCRIPTION OF THE PREFERRED EMBODIMENTS

In the following paragraphs, one of the practical embodiments of the present invention will be discussed in detail by referring to the accompanying drawing figures.

FIGS. 1 to 5 show an embodiment of a terminal inserting guide assembly according to the present invention.

Figure 6:
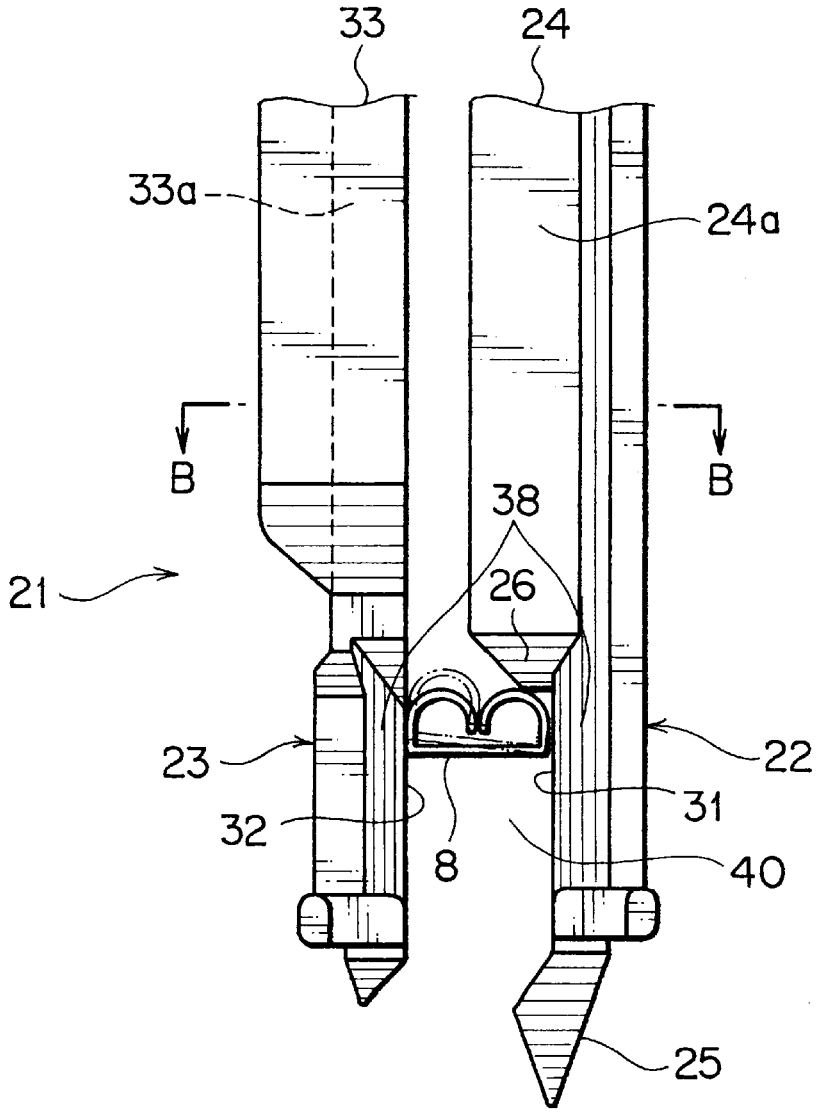
FIG. 6 PRIOR ART
FIG. 6 is a rear view of a previously known terminal inserting guide assembly.
Figure 7:
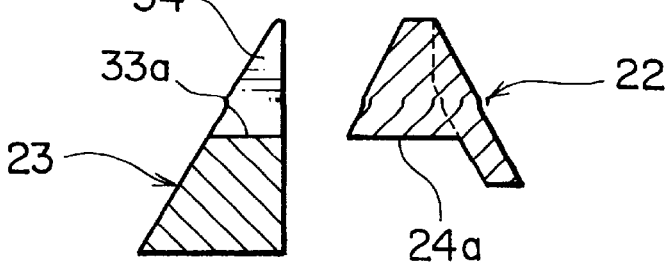
FIG. 7 PRIOR ART
FIG. 7 is a cross-sectional view taken along line B—B of FIG. 6.
Figure 8:
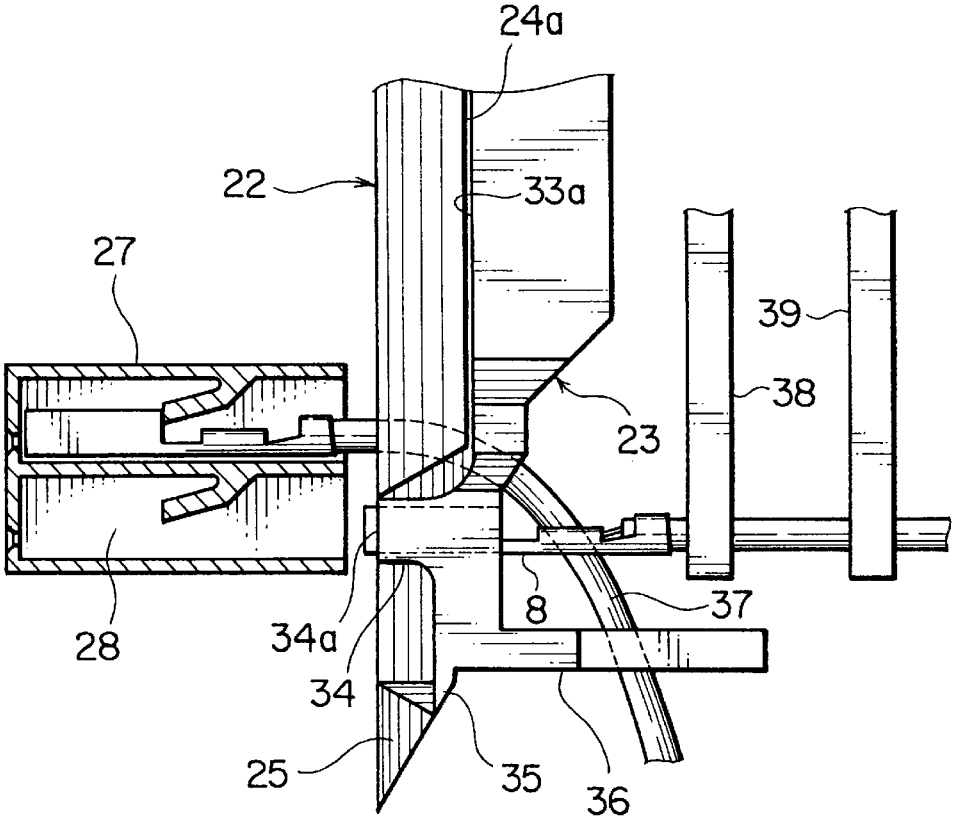
FIG. 8 PRIOR ART
FIG. 8 is a side view illustrating a state wherein a terminal is inserted into a connector housing (shown by a vertical cross-section)

The terminal inserting guide assembly 1 is composed of a pair of guide hooks 2, 3, as well as the previously known terminal inserting guide assembly shown in FIGS. 6 to 8. The guide hook 2 is formed with a tapered upper guiding surface 4 (i.e., a first upper guiding surface). Further, the other guide hook 3 is formed with another tapered upper guiding surface 5 (i.e., a second upper guiding surface) parallel to the upper guiding surface 4. Except for the other guide hook 3 having the upper guiding surface 5, the terminal inserting guide assembly 1 is constructed substantially in the same way as the previously known one.

The upper guiding surface 4 of the guide hook 2 is formed substantially in a triangle at an upper end of a terminal inserting, holding space 7 positioned in an intermediate portion of a frame bar 6. The upper guiding surface 4 has a horizontally flat edge 4*a* (i.e., a line contact portion) at a fore end thereof. The terminal 8 slidably contacts the horizontally flat edge 4*a* along the upper guiding surface 4.

Further, the upper guiding surface 5 of the other guide hook 3 is a tapered, right-angled triangle in shape. The upper guiding surface 5 is positioned in its intermediate height of a frame bar 9 and at a lower end of a guide block 10 extending from a side surface 9*a*. The guide block 10 may be formed as a body with the guide hook 3, or may be separately formed to be secured by small set bolts or similar to the frame bar 9.

Figure 2:
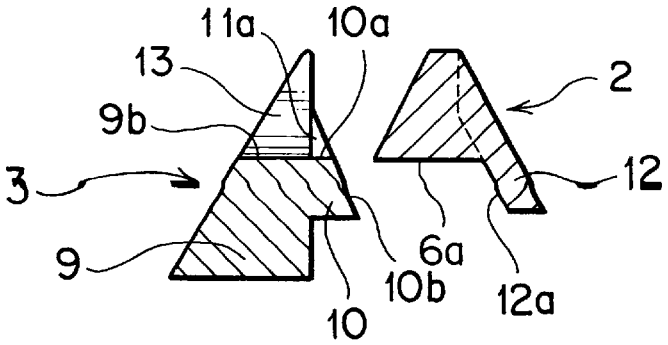
FIG. 2 is a cross-sectional view taken along line A—A of FIG. 1.
Figure 3:
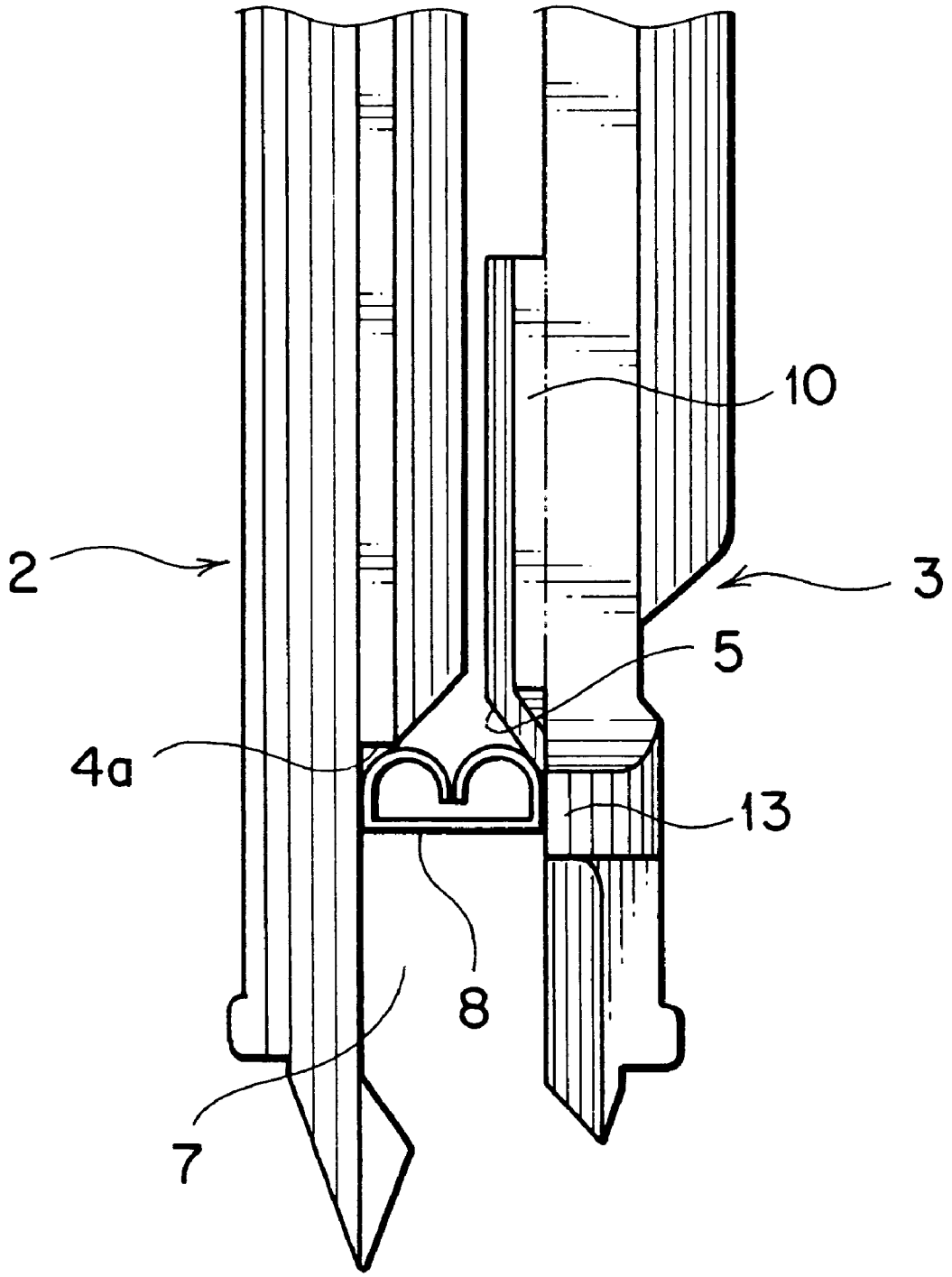
FIG. 3 is a front view of the terminal inserting guide assembly.
Figure 4:
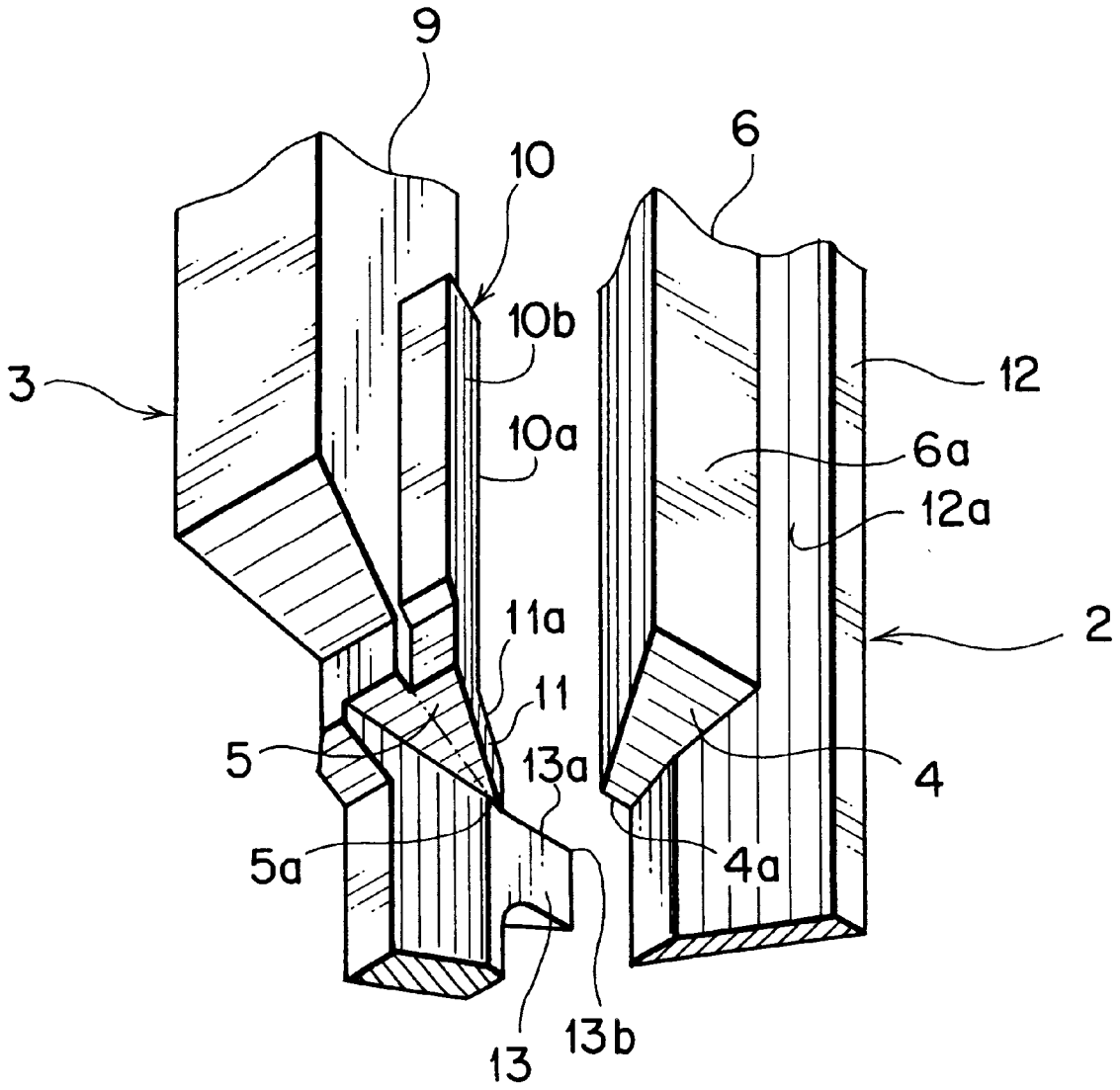
FIG. 4 is a perspective view showing upper guiding surfaces of a pair of separated guide hooks and their peripheries with regard to the terminal inserting guide assembly.

The guide block 10, as shown in FIGS. 2 and 4, is a substantially right-angled triangle shape in cross-section. Further, the guide block 10 is cut out to form a fore end 10*a* thereof. At a lower end of the guide block 10, a right-angled triangular, tapered extending portion 11 is provided downwardly, slightly inclined, and forwardly extending from the block 10 as a body. The second upper guiding surface 5 (FIG. 4) is a flat, right-angled triangular, tapered surface adjacent to a lower end of the guide block 10 and a lower end of the tapered extending portion 11. A fore end 5*a* (FIG. 4) of the upper guiding surface 5 has an acute angled tip. The fore end 5*a* of the upper guiding surface 5 may have a line-contact portion as well as the first upper guiding surface 4.

The fore end surface 10 *a* of the guide block 10, as well as a fore end surface 9*b* (FIG. 2) of the frame bar 9, contacts a rear surface 6*a* (FIG. 2) of the frame bar 5 of the guide hook 2. An upper surface 11*a* (FIG. 4) of the tapered extending portion 11 contacts the first upper guiding surface 4. A side surface 10*b* of the guide block 10 contacts an inner surface 12*a* of a rear extending portion 12 (FIG. 2 and FIG. 4) of the frame bar 6. Thereby, the pair of guide hooks 2, 3 can be closed compactly to be united with each other. As the previously known terminal inserting guide assembly, a terminal side guiding projection 13, extending forwardly from the other guide hook 3, is received in the holding space 7 and a smaller leading end 14 of the guide hook 3 is engaged with a larger leading end 15 of the guide hook 2. The pair of guide hooks 2, 3 are engaged with each other in their closed state to be compactly united in their lateral direction. Therefore, the guide hooks 2, 3 can be smoothly inserted between surrounding electric wires in front of the connector housing, while getting the wires out of the way.

Figure 5:
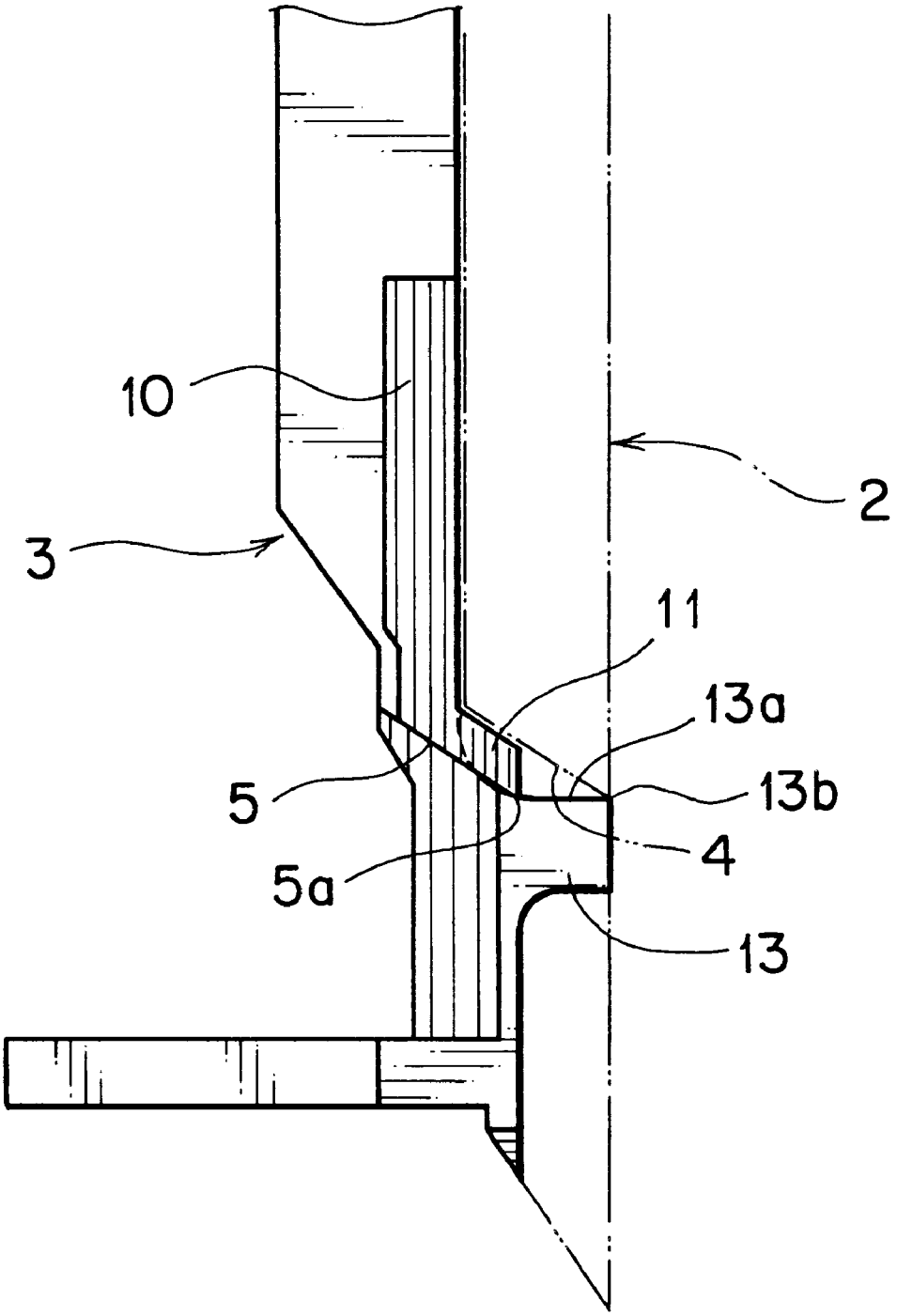
FIG. 5 is a side view illustrating the positional relationship between the upper guiding surfaces of the pair of guide hooks.

As shown in FIG. 5, the upper guiding surface 5 (i.e., a second upper guiding surface) of the guide hook 3 extends slightly forwardly in comparison to a root portion of the terminal side guiding projection 13. The fore end 5*a* of the upper guiding surface 5 is in line with an upper surface 13*a* of the side guiding projection 13. The guiding surface 4 (i.e., the first upper guiding surface) of the guide hook 2 is parallel with the second upper guiding surface 5. Further, the fore end 4*a* of the first upper guiding surface 4 is in line with a fore end 13*b* of the side guiding projection 13.

Figure 1:
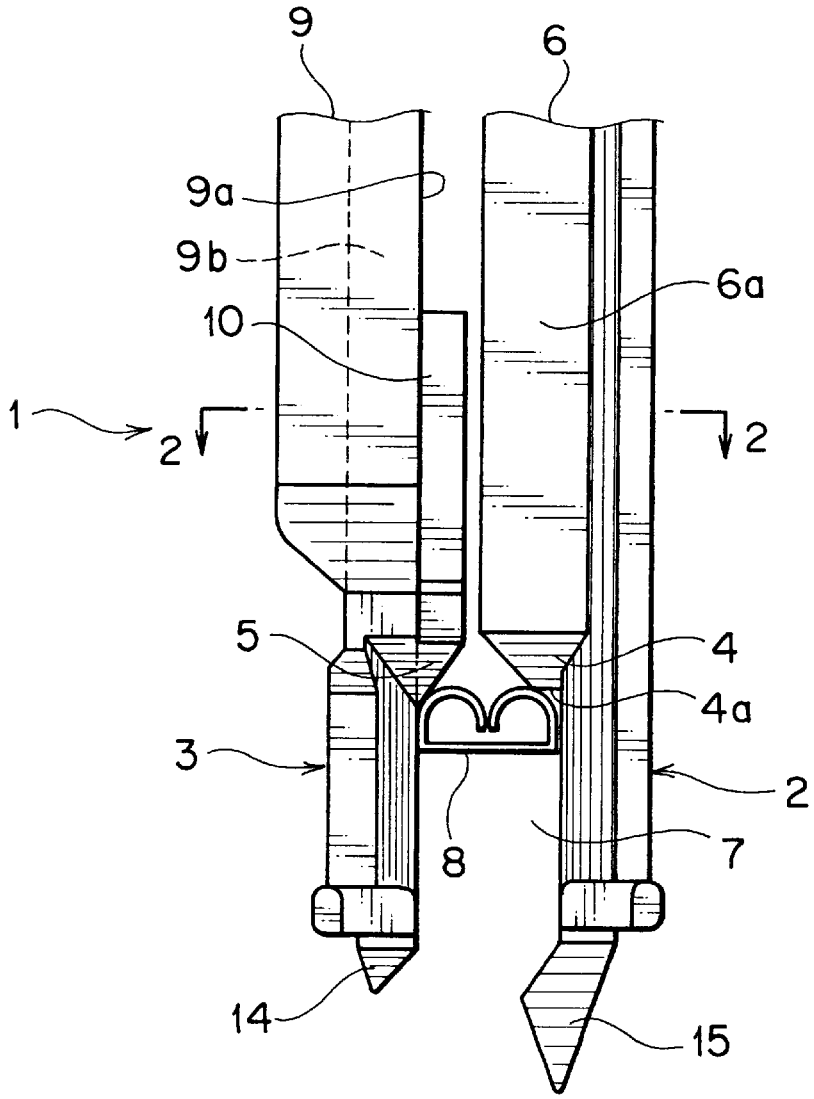
FIG. 1 is a rear view of a terminal inserting guide assembly of an embodiment according to the present invention.
Figure 9:
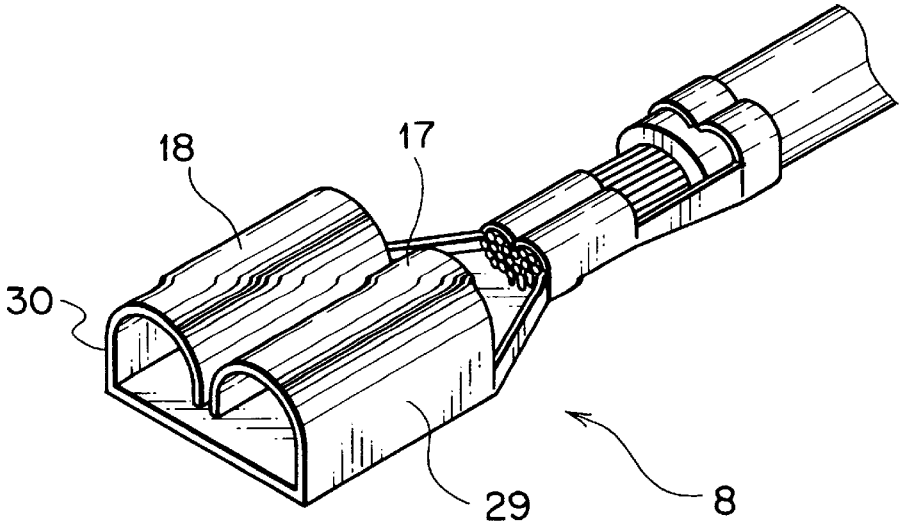
FIG. 9 PRIOR ART
FIG. 9 is a perspective view of a large-width type terminal having a curved surface.

Thus, as shown in FIG. 1, an upper surface of a large-width, curved-surface type terminal 8, delivered between the pair of guide hooks 2, 3, contacts the second upper guiding surface 5 and, at the same time, contacts the first upper guiding surface 4. That is, a curved surface 17 of the large-width, curved-surface type terminal 8, shown in FIG. 9, contacts the second upper guiding surface 5. At the same time, the other curved surface 18 of the terminal 8 contacts the first upper guiding surface 4. Thus, the large-width, curved-surface type terminal 8 can be inserted into the terminal accommodating chamber of the connector housing without an unstable inclination as with the previously known terminal inserting guide assembly.

Besides, the terminal inserting guide assembly 1 of this embodiment is not limited to the large-width, curved-surface type terminal 8, but can be naturally applied to a box-type female terminal.

As described above, according to the present invention, even the large-width, curved-surface type terminal can slidably contact each upper guiding surface of the pair of guide hooks so that the terminal can be reliably inserted into the connector housing while keeping its stable horizontal position. Thus, this eliminates the drawback of incomplete insertion of the terminal due to the instability of the positioning of the terminal. Moreover, the tapered extending portion, including the second upper guiding surface, can be received in the holding space which is cut out in one of the guide hooks. This achieves a compact pair of guide hooks, when closed, that can easily advance between surrounding electric wires.

What is claimed is:

1. A terminal inserting guide assembly comprising:

pair of guide hooks;

a first tapered upper guiding surface formed at an upper end of a cut-out portion inside a first of said pair of guide hooks;

a terminal side guiding projection formed in a second of said pair of guide hooks;

a tapered extending portion formed inside said second of said pair of guide hooks;

a second tapered upper guiding surface formed in said tapered extending portion;

wherein said terminal side guiding projection and said tapered extending portion are received in said cut-out portion of said first of said pair of guide hooks when said pair of guide hooks are closed, in a lateral direction thereof; and wherein said first and second tapered upper guiding surfaces act in cooperation to prevent a first end of said terminal from rotating with respect to a second end of said terminal in a holding space located between said pair of guide hooks in order to keep said terminal in a stable horizontal position.

2. The terminal inserting guide assembly as claimed in claim 1, wherein said first tapered upper guiding surface is inclined downwardly and forwardly with respect to a rear surface of a first frame bar from which said first tapered upper guiding surface extends and said second tapered upper guiding surface is inclined downwardly and forwardly with respect to a fore end surface of a second frame bar from which said second tapered upper guiding surface extends.

3. The terminal inserting guide assembly as claimed in claim 2, wherein an inward edge of said second tapered upper guiding surface is extended so as to be further inclined laterally and upwardly with respect to an inward edge of a rear surface of said second frame bar.

4. The terminal inserting guide assembly as claimed in claim 1, further comprising a rear extending portion which extends from a rear surface of said first guide hook of said pair of guide hooks.

5. The terminal inserting guide assembly as claimed in claim 4, further comprising a guide block attached to a side surface of said frame bar from which said second tapered upper guiding surface extends such that a side surface of said guide block contacts an inner surface of said rear extending portion.

* * * * *